United States Patent [19]

Dennis, Jr.

[11] Patent Number: 4,986,019

[45] Date of Patent: Jan. 22, 1991

[54] INDUSTRIAL SHOTGUN

[75] Inventor: William G. Dennis, Jr., Florissant, Mo.

[73] Assignee: Olin Corporation, Stamford, Conn.

[21] Appl. No.: 429,259

[22] Filed: Oct. 30, 1989

[51] Int. Cl.[5] ..... F41A 17/00; F41A 19/00

[52] U.S. Cl. ..... 42/69.01; 42/70.06; 42/106; 89/1.1

[58] Field of Search ..... 42/69.01, 69.02, 70.06, 42/28, 34, 106; 89/1.1

[56] References Cited

U.S. PATENT DOCUMENTS

| | | | |
|---|---|---|---|
| 202,126 | 4/1878 | Sneider | 42/28 |
| 445,880 | 2/1891 | Warnant-Crean | 42/29 |
| 1,341,117 | 5/1920 | Fischer | 42/106 |
| 2,606,384 | 8/1952 | Perry | 42/28 |
| 2,607,148 | 8/1952 | Simpson | 42/69.01 |
| 3,091,878 | 6/1963 | Savoli | 42/69.01 |
| 3,141,254 | 7/1964 | Savoli | 42/70.06 |
| 3,168,788 | 2/1965 | Coulter | 42/69.01 |
| 3,507,184 | 4/1970 | Prybyla | 89/33.05 |
| 4,341,031 | 7/1982 | Palmer et al. | 42/24 |
| 4,444,088 | 4/1984 | Olson | 89/25 |
| 4,869,008 | 9/1989 | Rasmussen | 42/69.01 |

*Primary Examiner*—David H. Brown
*Attorney, Agent, or Firm*—John R. Wahl

[57] ABSTRACT

An industrial shotgun is provided with a pistol type hand grip assembly, a remote trigger mechanism, and a hanging support bracket at approximately the center of mass of the industrial gun. The remote trigger mechanism includes a remote trigger coupled from the hand grip to the trigger through a horizontal linking bar. The trigger is disengaged from the remote trigger when the breech block is opened. The hand grip includes a dead man safety which prevents remote trigger actuation unless the thumb operated dead man safety is depressed and the breech block is fully closed.

15 Claims, 3 Drawing Sheets

INDUSTRIAL SHOTGUN

This invention relates to industrial guns and more particularly to a light weight industrial shotgun for use in residue removal from the interior surfaces of heated equipment such as boilers.

Industrial guns have found increasing use in situations where it is necessary or desirable to dislodge equipment obstructions and residues from equipment at fairly large distances from access ports of heated equipment where it would be unsafe for humans to enter to dislodge the obstructions or where it is desirable to remove these obstructions and residues without shutting down the equipment. For example, industrial 8-gauge guns are currently used to remotely dislodge rings of residue which form in rotary kilns for the production of cement rather than to have to allow the kiln to cool off so that personnel can enter the interior of the kiln to dislodge the cement residue rings. In this case, a keyway must be cut through the ring and the kiln rotated to dislodge the ring. Other applications include removing deposits from silos, electric furnaces and reverb furnaces.

The industrial gun must be securely mounted to a heavy adjustable support structure which can provide minute changes in aiming direction to permit the fired projectiles or shot to progressively chip at the residue to make such a cut. In addition, several thousand rounds of ammunition must be fired in such a gun during a single kiln cleaning operation. Accordingly, aiming of these guns is usually accomplished through mechanical gearing linkages and the operator typically utilizes a lanyard attached to the trigger to manually fire the gun when loaded and properly aimed.

The conventional industrial gun has a Martini action utilizing a lever actuated rotating breech block and a lanyard operated trigger. This requires two people for fast operation since the two hands of the shooter are needed to operate the breech block lever and the lanyard leaving the second person to load the shells into the gun. Some industrial guns have an auto fire mechanism which automatically fires the gun when the breech block is raised to the fully upright closed position.

U.S. Pat. No. 4,444,088, assigned to the assignee of the present invention, discloses such an auto fire assembly for an industrial shotgun wherein trigger actuation and firing automatically takes place upon closure of the breech block of the gun. This permits very rapid firing of the industrial shotgun and minimizes the time required in such operations.

These conventional industrial guns are well suited for relatively stationary use where there is plenty of access room adjacent the kiln. However, for cleaning clinkers or other slag from such enclosures as coal fired boilers, a lighter weight swivel mounted base has been utilized with the conventional industrial gun. This kind of pedestal support is still quite heavy and cumbersome. It has limited usefulness in boiler application where access is limited because of the vertical design of the boiler and piping congestion near the access ports. In addition, the conventional industrial shotguns lack a positive, interlocking safety to preclude unintentional firing of the shotgun once it is loaded. The conventional industrial guns are too heavy to manually carry and manipulate into tight places as is often the case with the boiler access ports.

Standard shotguns have typically been utilized, modified with extra padding on the butt of the stock, to reach those portions of the boiler which cannot be reached through access openings which are readily accessible to the heavy, floor supported gun. Operator discomfort and fatigue become substantial in these cases. In addition, standard, shoulder fired shotguns are smaller in gauge, typically 10 or 12 gauge. A smaller shot charge or projectile is utilized which requires many more shots and a substantially longer time to complete the job.

The industrial shotgun according to the present invention solves these problems by providing a light weight industrial shotgun that can be carried (weighing about 55 pounds) and operated in remote locations and has an integral dead man safety feature to prevent unanticipated discharges. The industrial shotgun of the present invention increases the versatility of the industrial gun by reducing its bulk and weight and providing a new way to mount, operate and fire the gun. It also provides more firepower than standard shoulder fired shotguns in these remote locations.

The industrial gun of the present invention includes a conventional receiver frame adapted to be vertically suspended from a point above the frame, a barrel having its breech end attached to the forward end of the frame, a breech block movably supported in the frame between an upper, closed position closing the firing chamber formed through the forward end of the frame and the breech end of the barrel, and an open position permitting ejection and insertion of a shotshell. The gun is vertically supported and suspended from a chain fall or other such device by a bracket attached to the gun frame at a point approximately the center of gravity of the gun. A pistol type hand grip assembly is attached to the aft end of the frame for maneuvering and aiming the barrel of the gun into the boiler. The movable breech block, actuated by an operating handle, also includes a conventional trigger, cam, and spring operated firing pin assembly for cocking the firing pin when the breech block is moved from the closed position to the open position.

An auxiliary handle is also provided off one side of the hand grip assembly to further steady and aim the gun since it is freely hanging. The operating handle and auxiliary handle are designed to be installed on either the right or left hand side of the gun to suit the shooter's preference.

A remote trigger mechanism is movably supported by the hand grip assembly and adapted to be operably coupled with the trigger only when the breech block is closed. Finally, a spring biased safety is movably supported within the hand grip assembly and operably coupled in an interference relationship with the remote trigger mechanism. This safety permits actuation of the remote trigger mechanism only when the safety is moved out of the interference relationship.

More particularly, the hand grip assembly includes a hollow pistol grip shaped handle which supports the safety and the rear portion of the remote trigger mechanism. The safety is a vertically movable rod which is slidably disposed in the housing formed by the hollow handle. This rod is upwardly urged by a spring. The rod has an axially offset end portion which extends upwardly out through a hole in the top portion of the handle. An operator depresses this end with his thumb. The safety rod has a shoulder at the base of the end portion on the forward side. The rod portion below this shoulder engages the rear end of the remote trigger mechanism to prevent trigger actuation unless the safety rod is depressed.

The remote trigger mechanism includes a horizontal remote trigger linking bar which has a forward portion of a first diameter and a rear portion of a reduced diameter. The forward portion of the bar is slidably disposed and supported in a front mounting bracket which is bolted to the underside of the receiver frame. The rear portion of the remote trigger linking bar is slidably supported in the hand grip. The rear end of the rear portion of the linking bar abuts against the safety rod portion below the shoulder. This same rear end of the rear portion of the linking bar has a horizontal notch to engage the shoulder of the safety rod. The horizontal notch at the rear end of the remote trigger linking bar engages the shoulder and permits rearward motion only when the button portion of the safety rod is fully depressed. A remote trigger is pinned to the rear portion of the bar and extends downwardly therefrom immediately forward of the pistol grip handle for retraction by the operator's finger after the operator has depressed the safety plunger rod with his thumb.

The forward portion of the trigger linking bar has a vertical slot therethrough. The trigger extends downwardly from the breech block through this slot. The trigger is positioned to engage stop at the forward end of the closed slot when the breech block is in the closed position. Pulling the remote trigger with the safety depressed pulls the linking bar rearward actuating the trigger. When the breech block is moved from the closed position, the trigger is mechanically displaced downwardly through the slot out of engagement with the stop on the forward end of the linking bar. Thus, when properly adjusted, the trigger of the industrial gun in accordance with the present invention may only be actuated when the breech block is in the closed position and the safety button is depressed. This combination prevents premature or inadvertent firing of the industrial gun.

The invention will be better understood by a reading of the following detailed description with reference to the attached drawings in which.

Figure 1:
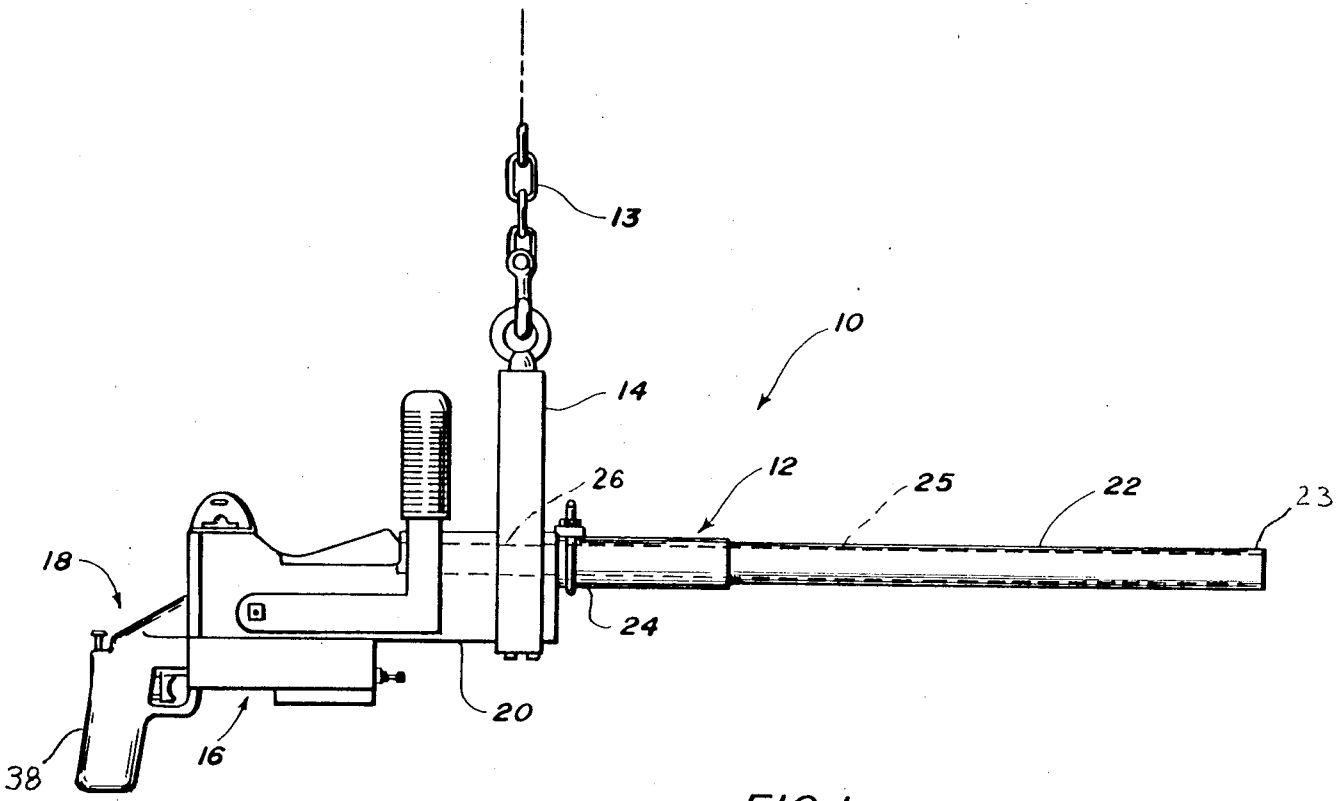
FIG. 1 is a side elevational view of the industrial shotgun assembly of the present invention.

The industrial shotgun assembly 10 in accordance with the present invention is shown in FIG. 1. The shotgun assembly 10 comprises industrial gun 12 supported from a chain fall 13 by hanging support bracket 14. A remote trigger mechanism 16 couples the firing mechanism to a pistol type hand grip assembly 18 bolted to the rear face of industrial gun 12.

Industrial gun 12 includes a receiver frame 20 which is suspended by the support bracket 14 from a point above the frame 20. A barrel 22 having a muzzle end 23 and a breech end 24 is attached to the forward end of the frame 20. The barrel 22 has a central bore 25 therethrough forming a firing chamber 26 at the breech end 24 for receiving a shotshell, typically of the 8-gauge size.

Figure 2:
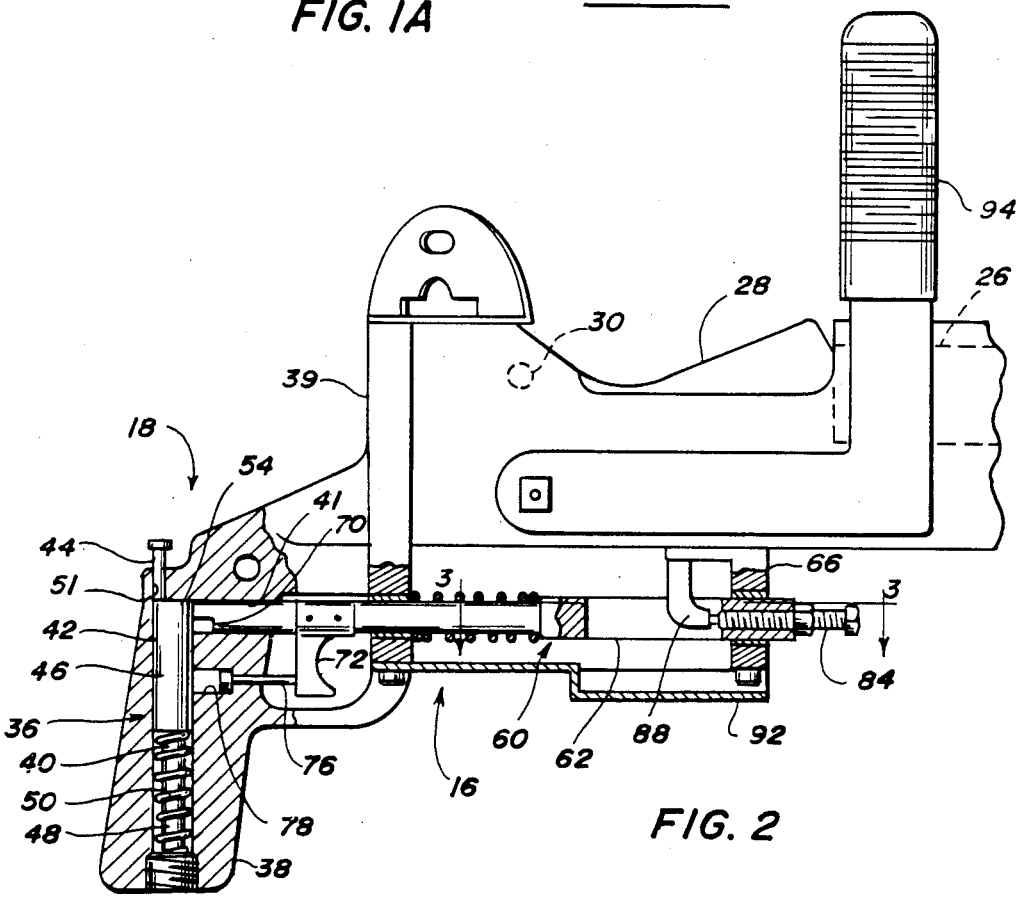
FIG. 2 is an enlarged partial right side view with portions in section showing the industrial shotgun in the firing position with the breech block closed.
Figure 3:
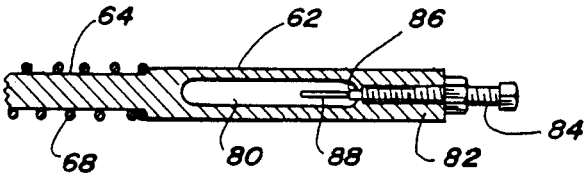
FIG. 3 is a sectional view taken along the line 3—3 in FIG. 2.
Figure 4:
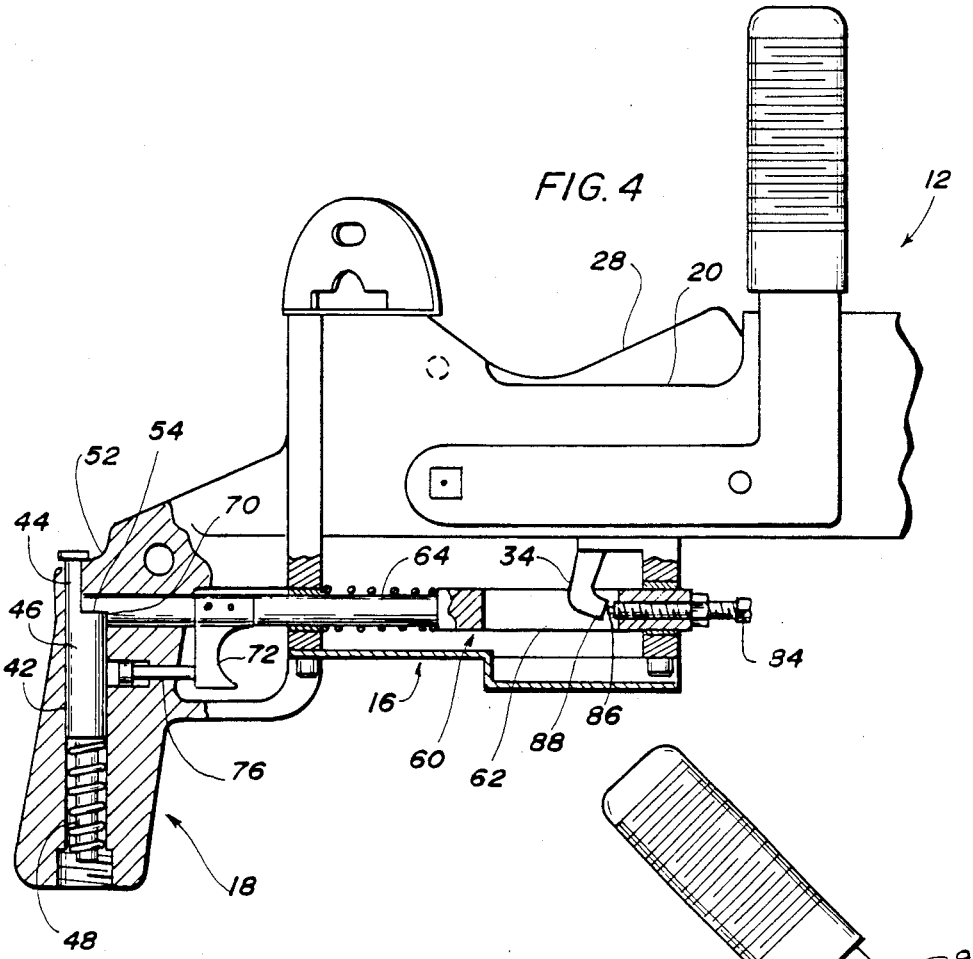
FIG. 4 is a side view as in FIG. 2 with the dead man safety depressed and remote trigger retracted to discharge the industrial shotgun.
Figure 5:
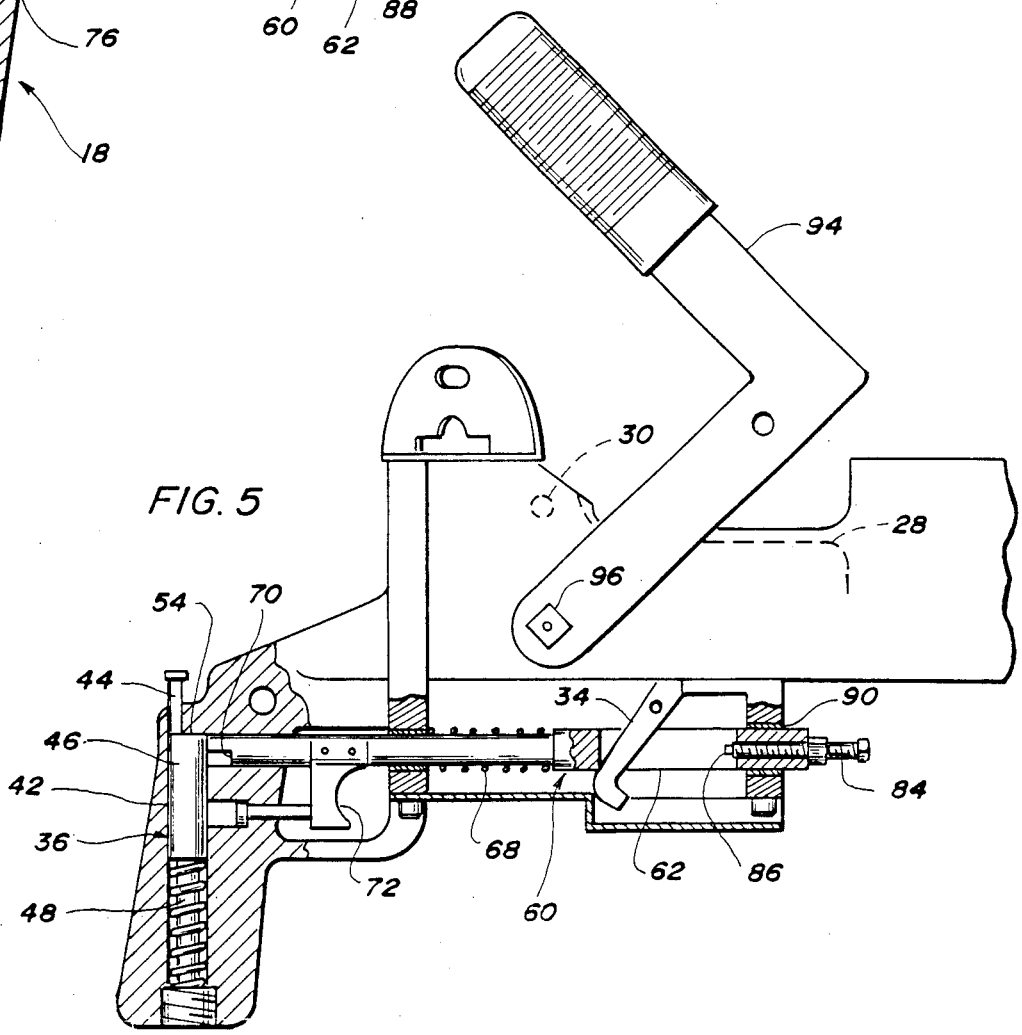
FIG. 5 is side elevational view as in FIG. 2 with the breech block open.

Pivotally residing within receiver frame 20 is a breech block 28 which pivots about pivot pin 30 between a lowered, open position as shown in FIG. 5 and a closed position closing off the firing chamber 26 as shown in FIGS. 2 and 4.

A trigger means which includes a firing pin assembly, sear, various springs and cams, and a trigger 34 are carried within receiver frame 20 and breech block 28. The trigger 34 is operably coupled to the firing pin in the breech block 28 for firing the shotshell when the breech block 28 is in the upper or closed position as shown in FIGS. 1, 2 and 4. The trigger 34 is an elongated, flat metal stock member having a general "L" shape. The upper portion of trigger 34 is pivotally attached to the breech block 28. The lower end of trigger 34 hangs beneath the breech block 28 such that trigger 34 moves up and down with breech block 28.

Figure 1A:
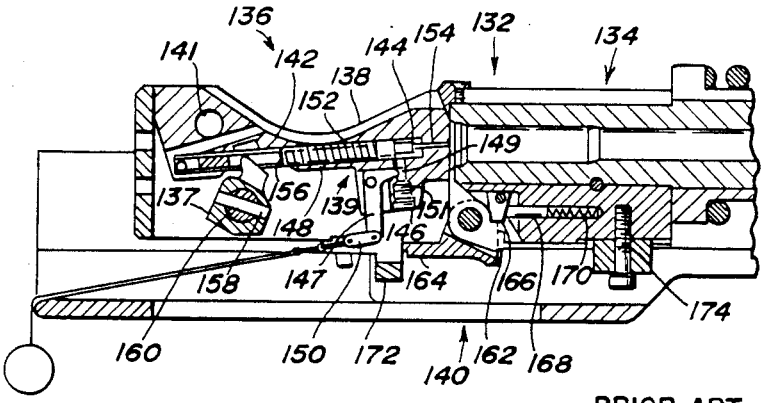
FIG. 1A PRIOR ART
FIG. 1A is a vertical crosssectional view through a receiver of a prior art lanyard operated industrial gun.

FIG. 1A shows the operational parts of a lanyard operated industrial gun. In the lanyard operated gun, a receiver 132 is provided comprising a barrel assembly 134 and a breech block assembly 136. Breech block assembly 136 includes a cocking cam 137, a breech block 138, a firing mechanism 139 and an extraction mechanism 140. Block 138 further comprises a pivot pin 141 a loading ramp 142, a bore 144 and a foot portion 146. The forward end of block 138 is shown in the fully upright closed breeching position in which block 138 is aligned with the chamber bore of barrel assembly 134 so that the cartridges can be fired by actuation of firing mechanism 139. Block 138 can rotate downwardly from the position shown to the second position in which the bottom of foot portion 146 rests against the top of a stop bracket 172 attached to the bottom of receiver 132. In this second downward position, loading ramp 142 is aligned with the bottom of the chamber bore of barrel assembly 134 so that a cartridge can be placed on ramp 142 and slid into the chamber bore for later firing. Breech block 138 is rotated between these two positions by rotation of cocking cam 137. IT will be seen that when cocking cam 137 is rotated counterclockwise it presses rearwardly against the lower portion of block 138 thus rotating block 138 downwardly in a clockwise direction until foot portion 146 contacts the stop bracket 172, as mentioned above. One of the portions of block 138 which is contacted by cocking cam 137 is a cam slot 156 of the firing pin 148 of the firing mechanism 149. Thus any time the gun is being cocked by moving the firing pin to the rear, the breech block is lowered out of the upright position and into its downwardly position. The cocking cam must subsequently by returned to its original position in order to move the breech block back to its upright position in order to allow the gun to be fired. Firing mechanism 139 comprises a trigger 147, a firing pin 148, a sear 149, a pull chain or lanyard 150, a sear spring 151 and a firing spring 152. Firing pin 148 lies within bore 144 of block 138 and has a tip 154 extending through the breech face or forward end of block 138 into a position substantially centered with the breech end of the barrel of the gun. As lanyard 150 is pulled downward it is evident that trigger 147 will be rotated clockwise and pull sear 149 downwardly to release firing pin 148 under the bias of firing spring 152. When lanyard 150 is released sear spring 151 will push sear 149 back into a position locking firing pin 148 as soon as firing pin 148 is moved rearwardly during the cocking procedure. Cocking cam 137 is held onto a cam shaft 160 by a cam pin 58.

The remote trigger mechanism 16 is bolted between hand grip assembly 18 and frame 20 and is slidably supported by the hand grip assembly 18 and adapted to be operably coupled to the trigger 34 only when the breech block 28 is in the upper, closed position. A spring biased safety 36, more fully described below, is slidably arranged within handle assembly 18 in an interference relationship with the remote trigger mechanism 16 such that the trigger 34 can only be actuated, discharging the industrial gun 10, when safety 36 is depressed out of the interference relationship with the remote trigger mechanism 16.

The hand grip assembly 18 has a partially hollow pistol grip handle 38 extending outwardly and downwardly from a vertical rear mounting plate portion 39 which is bolted to the rear face of the receiver frame 20. The pistol grip handle 38 has a vertical bore 40 therein which slidably supports the safety 36. The handle 38 also has a horizontal bore 41 which intersects with bore 40.

Safety 36 preferably includes a generally cylindrical safety plunger rod 42 which has an axially offset upper end portion 44 having an elongated rod shape, an intermediate portion 46 and a lower portion 48 of reduced diameter. A spring 50 is compressed between the bottom of pistol grip handle 38 and intermediate portion 46 around lower portion 48 to urge plunger rod 42 upward pushing end 44 out through a hole 51 through a shoulder 52 on top of the pistol grip handle 38. The elongated end portion 44 is of reduced diameter and axially offset to the rear from intermediate portion 46 so as to form a front shoulder 54 at the intersection of end portion 44 and intermediate portion 46.

The remote trigger mechanism 16 includes a generally cylindrical, horizontal remote trigger linking bar 60 having a forward portion 62 of a first diameter and a rear portion 64 of a reduced diameter both on a common axis. The forward portion 62 is slidably disposed and supported through a front mounting bracket 66 which is bolted to the underside of receiver frame 20.

The rear portion 64 of remote trigger linking bar 60 is slidably supported through rear mounting plate portion 39 and into the horizontal bore 41 in pistol grip handle 38. A spring 68 around the rear portion 64 is compressed between mounting portion 39 and forward portion 62 urges bar 60 forwardly. The rear end of rear portion 64 of the remote trigger linking bar 60 engages or abuts the intermediate portion 46 of the safety rod 42. The rear end of the rear portion 64 also has a horizontal notch 70 therein. Notch 70 allows rearward motion of remote trigger linking bar 60 only when the intermediate portion 46 of the safety plunger rod 42 is depressed such that the shoulder 54 allows the rear portion 64 of trigger bar 60 to slide thereover.

A remote trigger 72 is attached to the rear portion 64 and extends downwardly therefrom immediately forward of pistol grip handle 38. Remote trigger 72 may be pulled to urge trigger bar 60 rearwardly against spring pressure when end portion 44 is fully depressed. When the remote trigger 72 is released, bar 60 moves forward by spring pressure from spring 68. A stabilizing rod 76 attached to the lower end of remote trigger 72 slides in a second, lower horizontal bore 78 in the pistol grip handle 38 to prevent rotational movement of the remote trigger 72 about the axis of the linking bar 60.

The forward portion 62 of the remote trigger linking bar 60 has an elongated vertical slot 80 therethrough that is closed at the front end 82 of the forward portion 62. The slot 80 allows the lower portion of trigger 34 to move freely therethrough in a vertical direction when breech block 28 is moved between the upper closed position as shown in FIG. 2 and the lower open position as shown in FIG. 5.

Threaded through the front end 82 of the forward portion 62 is a trigger adjusting bolt 84. The rearward tip 86 of trigger adjusting bolt 84 is adjusted to abut the forward lower end 88 of trigger 34 when the breech block 28 is in the raised and closed position. The forward portion 62 of remote trigger bar 60 is slidably carried in a sleeve bushing 90 in front mounting bracket 66 to minimize friction during horizontal movement of the trigger bar 60 as is illustrated between FIGS. 2 and 4. Finally, a guard cover 92 is bolted over the remote trigger mechanism 16 to prevent the intrusion of dust and other debris during industrial gun operation.

The operation of the industrial shotgun 12 in accordance with the present invention is best illustrated beginning with FIG. 5. An operating handle 94 is rotated counter clockwise about a cocking cam shaft 96 pivotally mounted in frame 20 to lower the breech block 28 to the open position. This motion rotates breech block 28 clockwise about pivot pin 30 and causes downward movement of the trigger 34 out of abutment with tip 86 of trigger adjusting bolt 84 as shown in FIG. 5. In this open position, a shotshell cartridge (not shown) may be inserted into the chamber 26 of the industrial shotgun 12. The counter-clockwise movement of handle 94 also cocks the firing mechanism (not shown), retracts the firing pin and engages the trigger 34 therewith.

Once a shotshell has been inserted into the chamber, handle 94 is then rotated clockwise to rotate breech block 28 to the closed and locked position as illustrated in FIGS. 2 and 4. This movement positions the end 88 of the trigger 34 against the tip 86 of the trigger adjusting bolt 84 of the remote trigger mechanism 16. The operator then aims the industrial gun 12, depresses end portion 44 of the safety plunger rod 42, and squeezes remote trigger 72. The rearward movement of trigger 72 in turn causes remote trigger linking bar 60 to move rearward, depressing trigger 34 as shown in FIG. 4 thus releasing the firing pin and discharging the shotshell in the industrial shotgun 12.

The industrial shotgun 12 of the present invention cannot be fired by pulling remote trigger 72 unless the end portion 44 of the safety plunger rod 42 is fully depressed. Thus, a conscious, dual action is required on the part of the operator in order to fire the gun. This dual actuation is designed to be accomplished with one hand due to the placement of plunger rod 42. The safety arrangement is simple and effective.

The combination of a hanging bracket 14 positioned at or about the center of mass of the industrial shotgun 12 coupled with the pistol grip handle assembly 18 provides a very light weight, maneuverable, industrial shotgun which can easily be carried by one person to otherwise inaccessible locations to effectively remove clinkers and other clinging debris from the internal tubes of a boiler.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A heavy recoil industrial gun for removing residue from heated equipment, said gun comprising:

a frame having a forward end and an opposite aft end;

a hanging means for vertically suspending said gun in a balanced condition;

a barrel having a muzzle end and a breech end attached to the forward end of said frame, said breech end of said barrel and said frame forming a firing chamber therethrough for receiving a cartridge therein;

a breech block movably supported in said frame movable between a closed position closing said firing chamber and an open position;

a hand grip assembly attached to said aft end of said frame for maneuvering and aiming said barrel of said gun into said heated equipment;

a trigger means operably coupled to said breech block for firing said cartridge when said block is in said closed position; and a remote trigger mechanism spaced from said trigger means and said breech block, said mechanism being slidably supported by said hand grip assembly and adapted to be operably coupled with said trigger means only when said breech block is closed.

2. The gun according to claim 1 further comprising:

a spring urged safety means operably coupled in interference relationship with said remote trigger mechanism for allowing actuation of said trigger only when said safety means is actuated.

3. The gun according to claim 2 wherein said safety means is a thumb actuated safety positioned on said hand grip assembly so that said safety and said remote trigger may be actuated by an operator with one hand.

4. The gun according to claim 3 wherein said hand grip assembly comprises a hollow handle forming a housing for said safety and a rear portion of said remote trigger mechanism.

5. The gun according to claim 4 wherein said safety is a vertically movable rod slidably disposed in said housing, said rod being spring urged upward and having one end extending upward out of said handle for and operator to depress, said rod having a shoulder thereon for engaging said rear portion of said remote trigger mechanism.

6. The gun according to claim 5 wherein said remote trigger mechanism is a forwardly spring urged horizontal bar having a front portion and a rear portion slidably in said housing, said bar having an elongated closed slot in the front portion thereof and a notch in the end of the rear portion for engaging said shoulder on said rod, said slot receiving a portion of said trigger means when said breech block is closed.

7. The gun according to claim 6 wherein said bar further comprises an adjustable stop member extending through the forward end of said front portion into said slot, said stop member engaging said trigger means to adjust the rearward movement of said bar necessary to actuate said trigger means when said safety is depressed.

8. The gun according to claim 2 further comprising a support bracket attached to said gun about a central supporting point, said bracket being adapted to movably hang said gun from an overhead support structure adjacent an opening into said equipment.

9. The gun according to claim 8 wherein said safety means is a thumb actuated safety positioned on said hand grip assembly so that said safety and said remote trigger may be actuated by an operator with one hand.

10. The gun according to claim 9 wherein said hand grip assembly comprises a hollow handle forming a housing for said safety and a rear portion of said remote trigger mechanism.

11. The gun according to claim 10 wherein said safety is a vertically movable rod slidably disposed in said housing, said rod being spring biased upward and having one end extending upward out of said handle for and operator to depress, said rod having a shoulder thereon for engaging said rear portion of said remote trigger mechanism.

12. The gun according to claim 11 wherein said remote trigger mechanism is a forwardly spring biased horizontal bar having a front portion and a rear portion slidably disposed in said housing, said bar having an elongated closed slot in the front portion thereof and a notch in the end of the rear portion for engaging said shoulder on said rod, said slot receiving a portion of said trigger means when said breech block is closed.

13. The gun according to claim 12 wherein said bar further comprises an adjustable stop member extending through the forward end of said front portion into said slot, said stop member engaging said trigger means to adjust the rearward movement of said bar necessary to actuate said trigger means when said safety is depressed.

14. A heavy recoil industrial gun for removing residue from heated equipment, said gun having a frame having a forward end and an opposite aft end and a barrel having a breech end attached to said forward end of said frame and together forming a firing chamber therethrough for receiving a cartridge therein, a movable breech block rotatably supported in said frame movable between a closed position closing said chamber and an open position, a hand grip assembly attached to said aft end of said frame, said hand grip assembly having a pistol grip handle forming a hollow housing extending below said frame, and a trigger means movably supported within said frame including a downwardly extending trigger member operably coupled to said breech block for firing said cartridge when said block is in said closed position wherein the improvement comprises:

a hanging bracket fastened to said receiver frame at about the center of gravity of said gun;

a remote trigger mechanism spaced from said trigger means and said breech block, said mechanism being slidably supported by said hand grip assembly and adapted to operably engage said trigger means only when said breech block is closed;

a thumb actuated safety positioned on said hand grip assembly so that said safety and said remote trigger may be actuated by a operator with one hand, said safety having a spring urged vertically movable rod slidably disposed in said housing, said rod having one end extending vertically out of said handle for an operator to depress, said rod having a shoulder thereon operably engaging a rear portion of said remote trigger mechanism in an interference relation preventing said remote trigger mechanism from engaging said trigger means until said safety rod is depressed.

15. The gun according to claim 14 wherein said remote trigger mechanism comprises a forwardly spring urged horizontal member having a front portion and rear portion, said rear portion being slidably disposed and forwardly spring urged in said housing, said front portion having an elongated vertical closed slot therethrough for passage of a lower end of said trigger member when said breech block is moved between said closed and open positions.

* * * * *